US007088913B1

(12) United States Patent
Verhoorn et al.

(10) Patent No.: US 7,088,913 B1
(45) Date of Patent: Aug. 8, 2006

(54) BASEBOARD/UPRIGHT HEATER ASSEMBLY

(75) Inventors: Derek A. Verhoorn, Stoneham, MA (US); Johnson Hsu, Framingham, MA (US); Andrew T. Sarkisian, Framingham, MA (US); Donald W. Bryce, Framingham, MA (US); Sarah V. Drake, Franklin, MA (US)

(73) Assignee: JCS/THG, LLC, Milford, MA (US)

( * ) Notice: Subject to any disclaimer, the term of this patent is extended or adjusted under 35 U.S.C. 154(b) by 23 days.

(21) Appl. No.: 10/878,246

(22) Filed: Jun. 28, 2004

(51) Int. Cl.
*F24D 15/02* (2006.01)

(52) U.S. Cl. ..... 392/367; 392/360

(58) Field of Classification Search ..... None
See application file for complete search history.

(56) References Cited

U.S. PATENT DOCUMENTS

| | | | | |
|---|---|---|---|---|
| 2,395,167 | A | 2/1946 | Collura | |
| 4,198,556 | A * | 4/1980 | Crowley et al. | 392/384 |
| 4,703,152 | A * | 10/1987 | Shih-Chin | 392/366 |
| 4,838,151 | A | 6/1989 | Shin-Chin | |
| D322,669 | S | 12/1991 | Yamamoto et al. | |
| D329,692 | S | 9/1992 | Chaney et al. | |
| D341,651 | S | 11/1993 | Cunning | |
| 5,429,481 | A | 7/1995 | Liu | |
| 5,518,370 | A | 5/1996 | Wang et al. | |
| D374,071 | S | 9/1996 | Wang et al. | |
| D377,683 | S | 1/1997 | Wang et al. | |
| D389,567 | S | 1/1998 | Gudefin | |
| 5,761,377 | A | 6/1998 | Wolfe et al. | |
| 5,790,748 | A | 8/1998 | Tamhane | |
| D408,510 | S | 4/1999 | Moreno | |
| D434,131 | S | 11/2000 | Fok | |
| 6,321,034 | B1 | 11/2001 | Jones-Lawlor et al. | |
| 2001/0031137 | A1* | 10/2001 | Jones-Lawlor et al. | 392/367 |
| 2003/0026600 | A1* | 2/2003 | Delonghi | 392/365 |

* cited by examiner

*Primary Examiner*—Thor S. Campbell
(74) *Attorney, Agent, or Firm*—Hoffman & Baron, LLP; Frank E. Marino

(57) ABSTRACT

A multi-purpose electric heater that can be configured as a baseboard heater or an upright heater is provided. The heater preferably includes a pair of elongate housings that are coupled to a base in a manner that allows them to be moved between horizontal and upright positions. Each housing may include a rotatable portion that can be oriented to direct heat where desired.

18 Claims, 14 Drawing Sheets

BASEBOARD/UPRIGHT HEATER ASSEMBLY

BACKGROUND OF THE INVENTION

1. Field of the Invention

The field of the invention relates to electric heaters, and specifically to heaters having versatility in directing heated air.

2. Brief Description of the Related Art

Electric heaters are commonly used for providing heat to rooms and offices. Many such heaters are portable, and are frequently used for providing supplemental heat. Such heaters may distribute air by convection, forced air, radiation, or a combination of such means.

It is often important to direct heat generated by an electric heater in order to maximize its benefits. Such heaters have accordingly been manufactured in a variety of forms. One such form is the "tower" type heater as disclosed in U.S. Pat. No. 5,761,377, which is incorporated by reference herein. Such a heater includes a rather tall, upright housing mounted to a base. Heated air exits through openings in the front face of the heater. Such openings are provided substantially throughout the front face, providing an elongate vertical area through which air can escape.

Electric heaters have also been designed in the form of baseboard heaters. Such heaters include elongate housings that are intended to be placed horizontally at the juncture of a wall and a floor. U.S. Pat. Nos. 5,790,748 and Des. 408,510 disclose two such heaters. A third such heater is disclosed in U.S. Pat. No. Des. 341,651. While this heater offers additional versatility in that the two elongate housings thereof are foldable with respect to a central base, its use is still limited as both housings remain horizontal regardless of position. It accordingly has use only as a baseboard heater regardless of how the housings are configured with respect to each other or to the base.

SUMMARY OF THE INVENTION

A multi-purpose electric heater is provided by the invention. The heater is preferably portable, and can be configured as a baseboard heater or an upright heater. This allows the user to select the configuration that best suits his heating needs.

A heater according to the invention includes a base and at least one housing mounted to the base. The housing has a first end proximate to the base and a second end remote from the base. A heating element is positioned within at least one of the base and housing(s). A portion of the housing is designed to allow the release of heat generated by the heating elements. The housing is coupled to the base in such a manner that the housing is rotatable about an axis extending between its first and second ends. Such rotation causes the housing to be movable between a first, substantially horizontal position and a second, substantially upright position.

In accordance with a preferred embodiment of the invention, the heater includes a base that can be placed on the floor of a room and at least one housing coupled to the base. The housing includes a first end proximate to the base and a second end remote from the base. A heating element is positioned within at least one of the base and housing. The housing may be vented, preferably with an elongate grill, to allow the escape of heated air. The housing is coupled to the base in such a manner that it can be moved between a substantially horizontal position and a substantially upright position. This allows it to be used as a baseboard heater as well as an upright heater. The heater preferably includes a pair of housings, each of which can be moved between horizontal and vertical positions by the user. The housing vents may be oriented upwardly when the housing is moved to the horizontal position. If the heater is designed to radiate heat as opposed to using a fan to move air past one or more heating elements, the housings would not require vents.

In accordance with another preferred embodiment of the invention, a combination baseboard and upright heater is provides. The heater includes a base, a first housing and a second housing. Each housing has a first end proximate to the base and a second end remote from the base. The housings are respectively connected to the base by first and second couplings. The couplings allow each housing to be moved to substantially horizontal and substantially upright positions. A heating element is positioned in the base and/or one or both housings.

DETAILED DESCRIPTION OF THE INVENTION

The detailed description which follows is directed to a preferred embodiment of the invention. It is not intended to limit the scope of the invention, which is defined instead by the appended claims.

Figure 1:
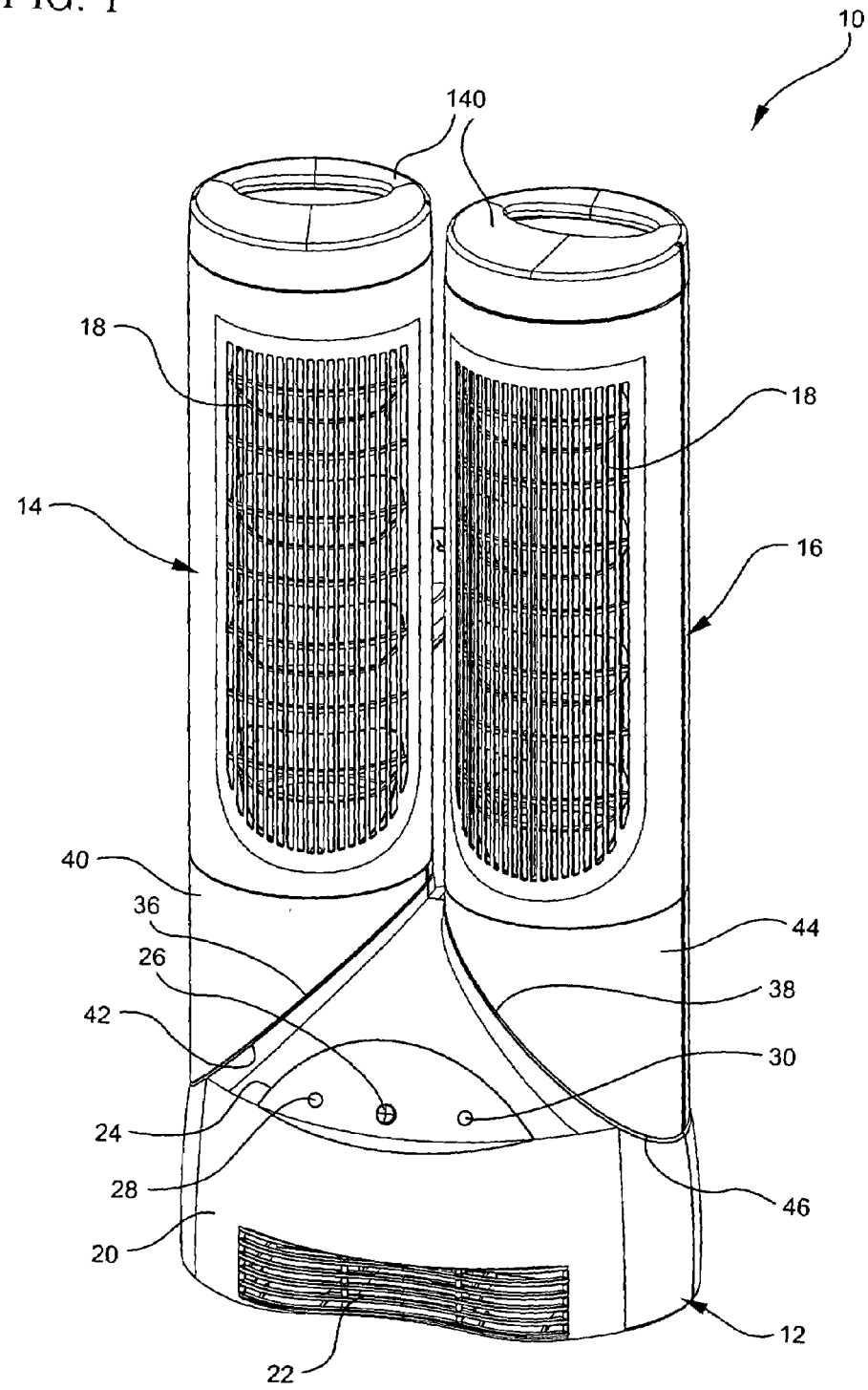
FIG. 1 is a top perspective view of a heating according to the invention deployed in a first configuration.
Figure 2:
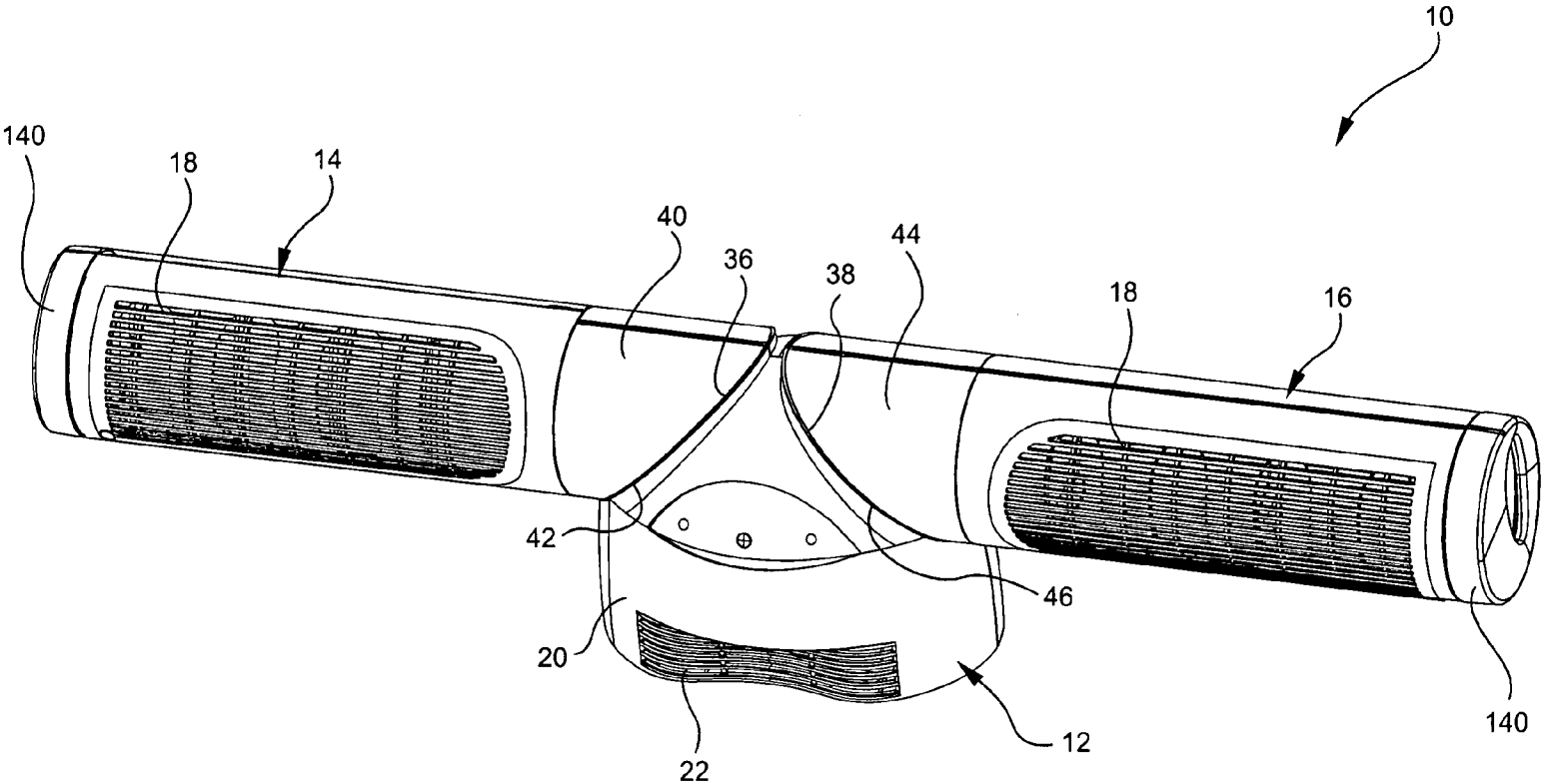
FIG. 2 is a top perspective view of the heater assembly as deployed in a second configuration.

Referring to FIGS. 1 and 2, a combined baseboard and upright heater 10 is shown. The heater includes a base 12, a first housing 14 and a second housing 16. Each housing is elongate and includes an elongate grill 18. A first end of each housing is proximate to the base, the opposite end being remote from the base. The housings 14, 16 are generally cylindrical, though other geometric configurations can be employed. Each housing can be moved with respect to the base. When the housings are moved to substantially horizontal positions, as shown in FIG. 2, the heater can be used as a baseboard heater. When both housings are substantially upright, as shown in FIG. 1, the heater can be employed as an upright or "tower" type heater. A user can, if desired, move one housing to a horizontal position and the other to a substantially vertical position. The grills 18 are positioned such that they face forwardly when the housings are substantially upright.

The heater base 12 of the preferred embodiment of the invention is sufficiently wide and heavy to prevent the heater from tipping over when one of the housings 14, 16 is moved to a horizontal position. As the longitudinal axes of the housings are substantially collinear when both are in a horizontal position, the heater is balanced when used solely as a baseboard heater. The housings are also preferably similar in height and weight, which also contribute to the stability of the heater in the baseboard configuration.

The base 12 includes a casing 20, the front portion thereof including a grill 22. A control panel 24 is positioned above the grill. The control panel includes an on/off switch 26. It also preferably includes control buttons 28, 30 for various heat settings such as "high" and "low". Controls may be electronic or manual.

Figure 6:
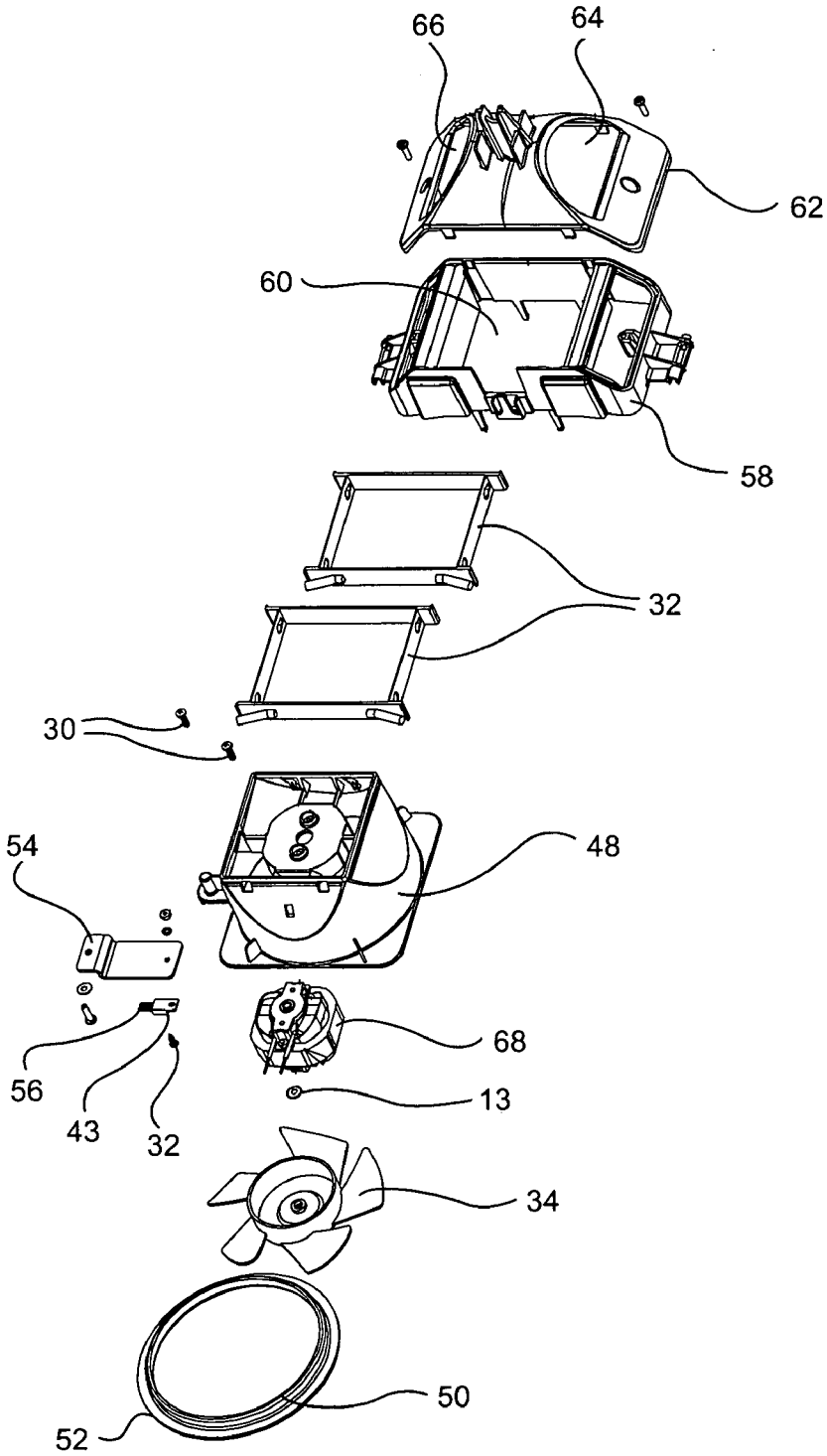
FIG. 6 is an exploded, perspective view showing elements contained in the base of the heater.
Figure 7:
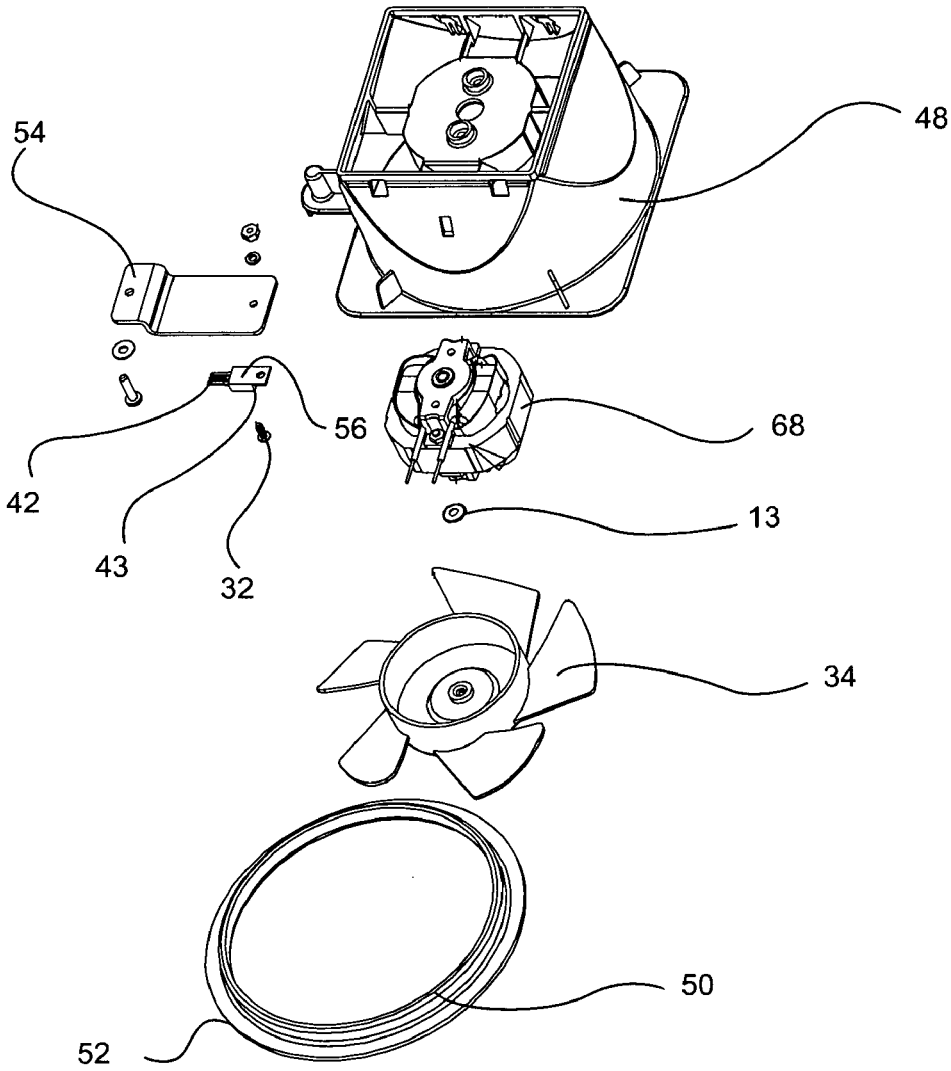
FIG. 7 is an enlarged, exploded perspective view showing several of the elements depicted in FIG. 6.

Referring to FIG. 6, two heating elements 32 are positioned within the casing. Heat generated by the heating elements is moved into the housings 14, 16 by a fan 34. Air is drawn into the base 12 through the grill 22, passes through the heating elements, and exits through the grills 18 in the housings 14, 16. The base 12 further includes a tip-over switch (not shown). It may further include an overcurrent device as described in U.S. Pat. No. 5,761,377.

The housings 14, 16 are pivotably coupled to the base 12 in a manner that allows them to be moved between upright and horizontal positions. They are also preferably coupled to the base such that the interior of each housing is in fluid communication with the interior space of the base. The base includes first and second inclined upper surfaces 36, 38. These surfaces extend upwardly towards the midpoint of the base 12. The first housing 14 includes a base or neck portion 40 having a first inclined end surface 42 that adjoins the first inclined upper surface 36 of the base. Likewise, the second housing 16 includes a base or neck portion 44 including a second inclined end surface 46 adjoining the second inclined upper surface 38 of the base.

Figure 3:
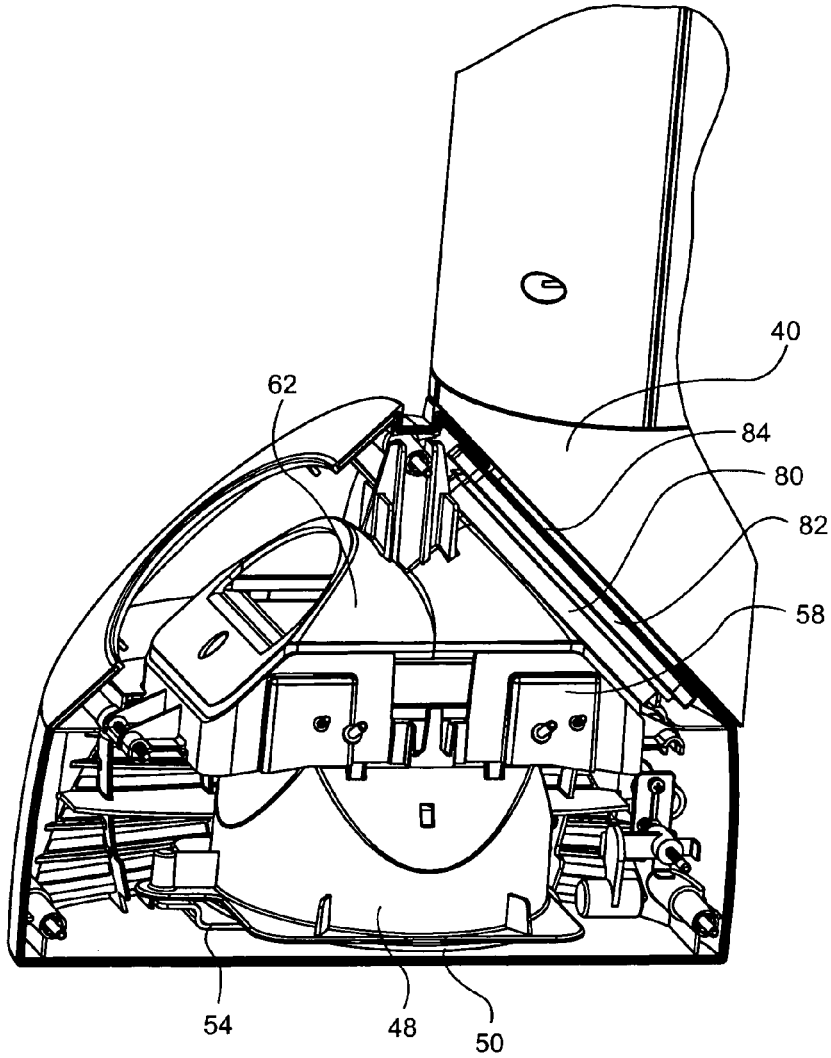
FIG. 3 is a partially cut-away, perspective view of the base of the heater.
Figure 4:
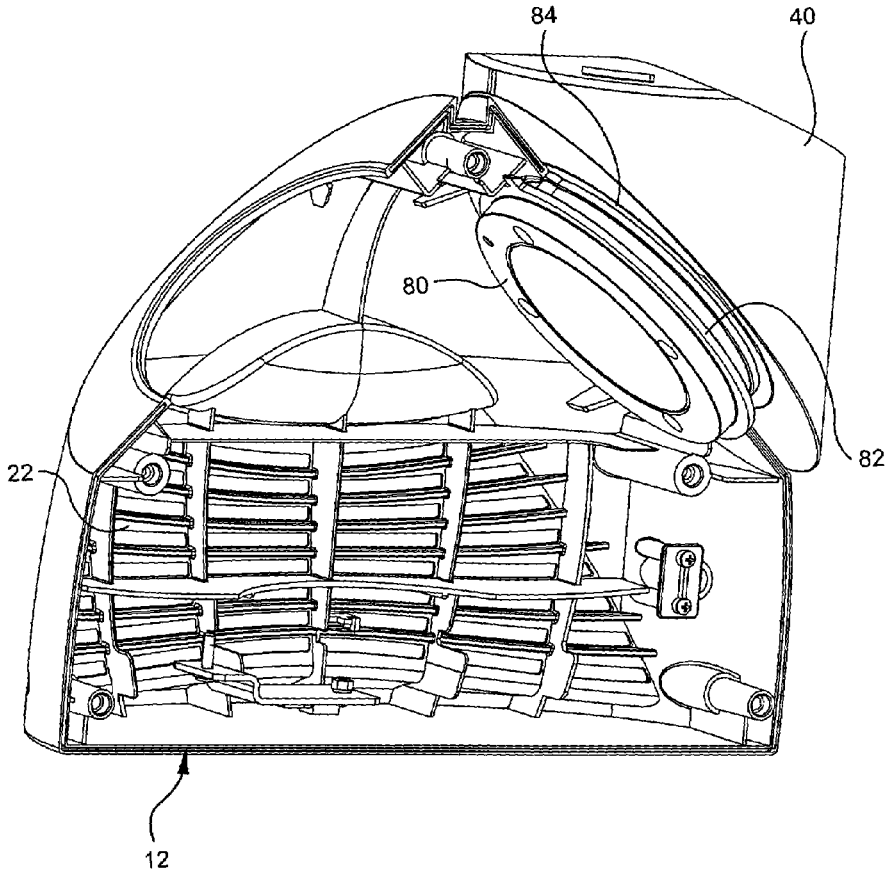
FIG. 4 is a similar view thereof with several elements omitted.
Figure 5:
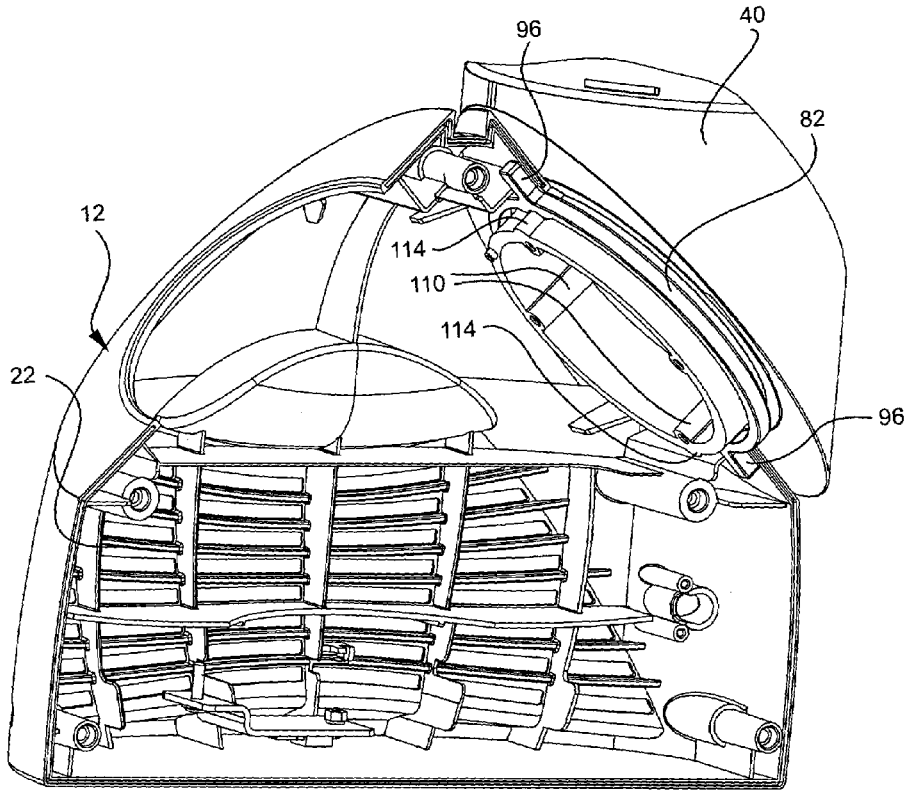
FIG. 5 is a similar view thereof with the neck retainer omitted.

FIGS. 3–5 show the interior of the base 12 and the bottom end of one of the base portions 40 of the housings. The other of the two base portions 44 is omitted from these Figures to better illustrate the upper end of the base. The housings 14, 16 are substantially the same, and are rotatably secured to the base 12 in substantially the same manner.

Referring to FIGS. 3 and/or 6, a fan housing 48 is positioned within the base. The fan housing includes top and bottom openings. The fan 34 adjoins the bottom opening. The walls of the fan housing taper inwardly in the direction of the top opening. A ring 50 including a laterally extending flange 52 is mounted to the bottom surface of the fan housing. The vertical portion of the ring extends within the fan housing.

A heat sink in the form of a bracket 54 is mounted to a laterally extending projection of the fan housing 48. An end portion of the bracket extends below the bottom opening of the fan housing, as shown in FIG. 3. A triac 56 is secured to the end portion of the bracket. The triac preferably includes a heat sink tab that allows it to be fastened to the bracket. This allows heat to be dissipated from the triac. The triac is connected to the control panel and functions as a switch for controlling power to the fan and heating elements.

A heater housing 58 is secured to the base 12, as shown in FIG. 3. It includes a generally rectangular channel 60. The top portions of the lateral walls bounding the channel are rounded. A heat shield 62 is mounted to the heater housing and includes a pair of generally semicircular openings 64, 66 formed within the lateral walls thereof. The lateral walls are inclined, substantially matching the angles of the inclined surfaces 36, 38 of the base.

The fan 34 is driven by an electric motor 68 mounted to the fan housing 48, as shown in FIG. 6. The heating elements 32 may be of the type including resistance wire supported by a mica frame. Other types of heating elements used in electric heaters for office or home use could alternatively be employed.

Figure 8:
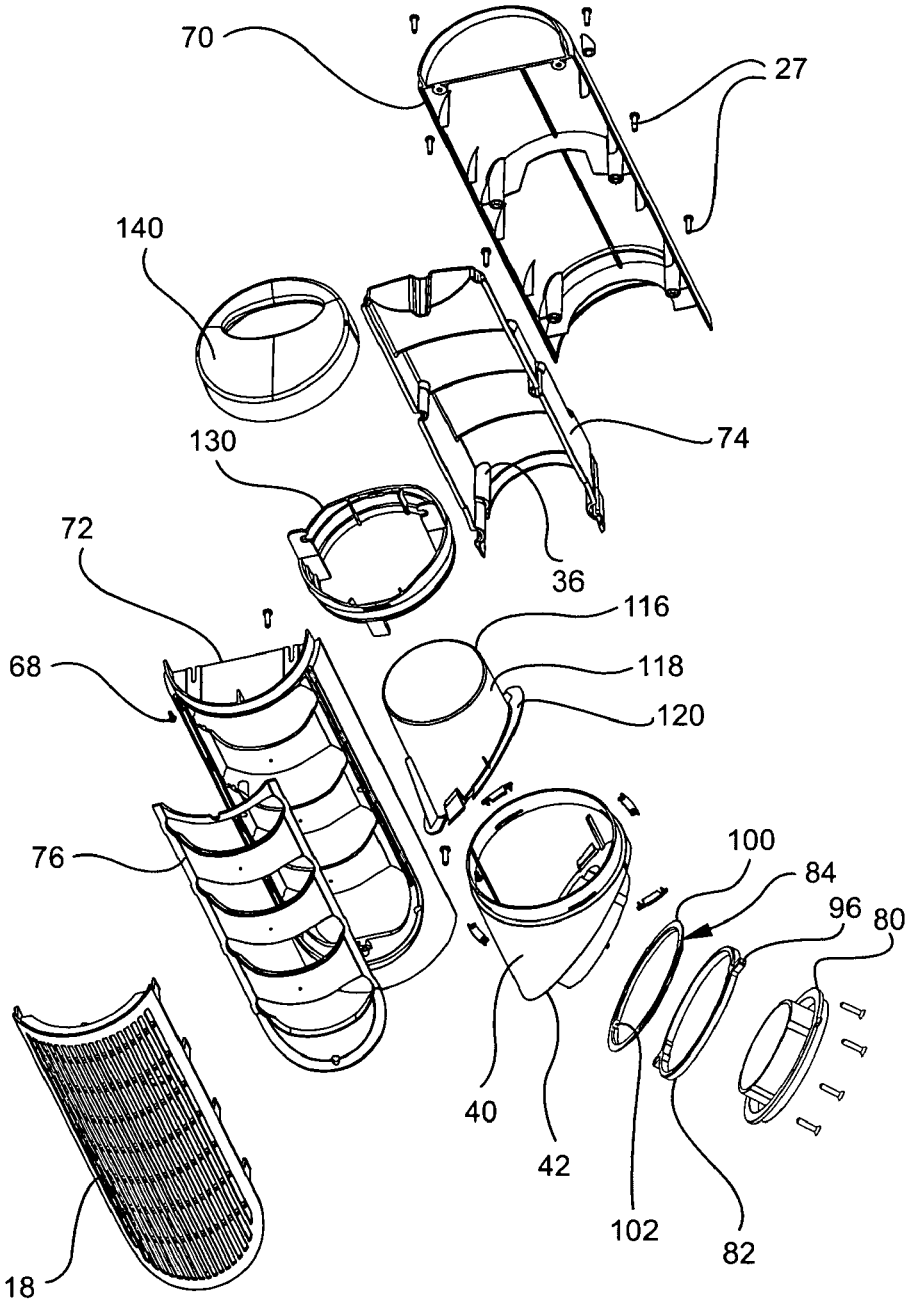
FIG. 8 is an exploded, perspective view showing one of the housings of the heater.
Figure 9:
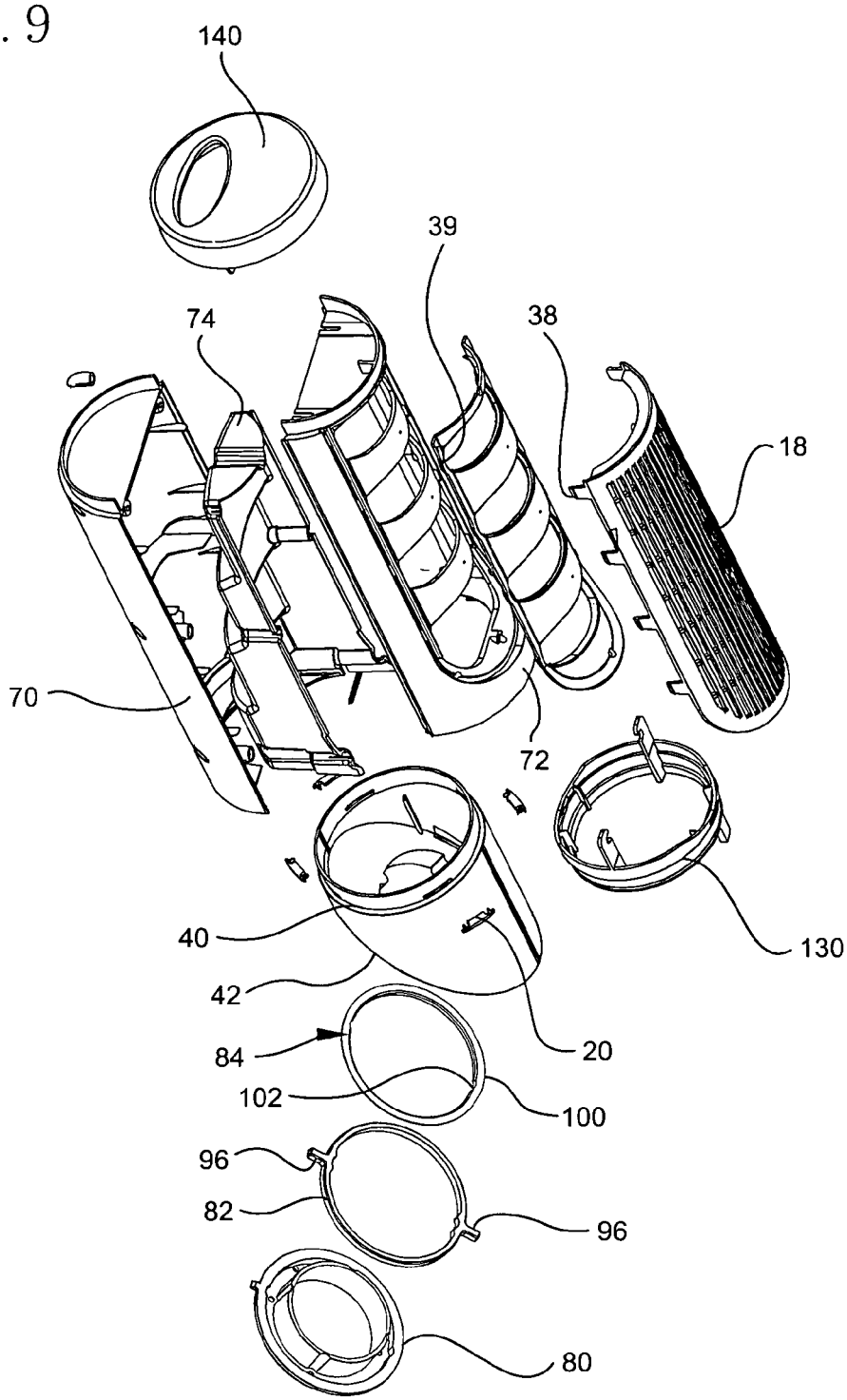
FIG. 9 is another exploded, perspective view thereof.

The components of the housings 14, 16 forming the "tower" portions of the heater are shown in FIGS. 8 and 9. Both housings are substantially the same in construction. Referring to FIG. 8, the first housing 14 includes a rear tower half 70 and a front tower half 72, each of which is generally semicylindrical. These elements are coupled to each other and rotatably coupled to the base portion 40 to form a generally cylindrical housing 14 having an inclined bottom surface 42. A tower duct 74 is positioned in adjoining relation to the rear tower half. The tower duct includes a stepped interior surface that reduces the volume of the air space within the housing from the bottom to the top. The flow of heated air from the air space through the grill 18 is relatively uniform due to the configuration of the tower duct 74. The front tower half 72 includes a plurality of large openings. A tower mask 76 having openings corresponding to those in the front tower half is provided primarily for decorative purposes. The tower mask 76 is mounted to the outer surface of the front tower half 72 such that the openings in both elements are aligned with each other. The grill 18 is positioned over the tower mask 76.

Figure 10:
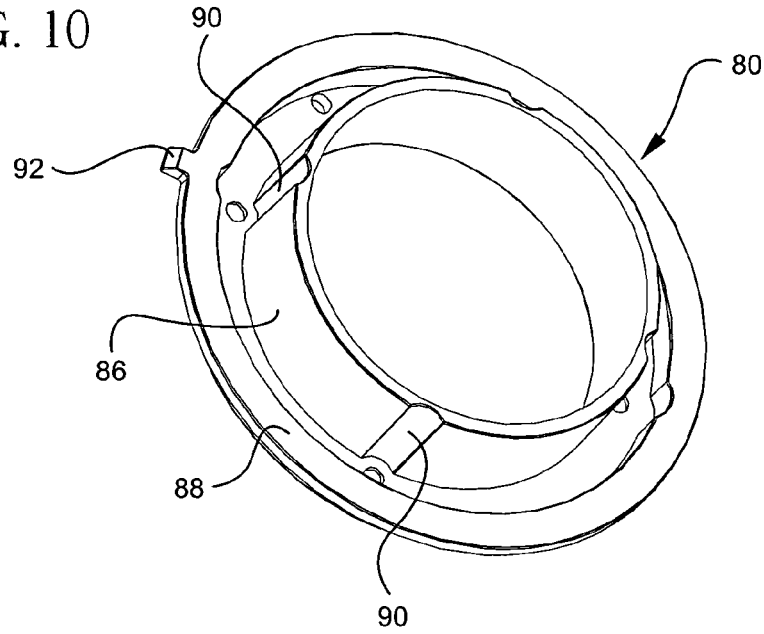
FIG. 10 is a top perspective view of a neck retainer.

A neck retainer 80, detent ring 82 and neck bearing 84 are positioned between the base 12 and the base portion 40 of the housing. As shown in FIG. 10, the neck retainer includes a cylindrical portion 86 and an annular flange 88. Four equally spaced channels 90 are formed in the outer surface of the cylindrical portion 86. A projection 92 extends radially outwardly from the annular flange 88.

Figure 11:
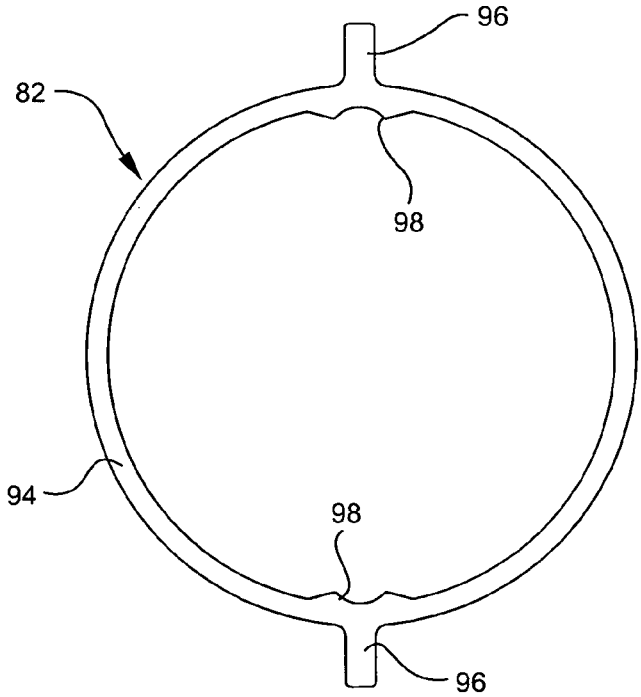
FIG. 11 is a top plan view of a detent ring.

Referring to FIG. 11, the detent ring 82 includes an annular body 94, a pair of diametrically opposite, radially outwardly extending projections 96, and a pair of diametrically opposed channels 98. The neck bearing 84, shown in FIG. 8, includes an annular body 100 having a pair of diametrically opposed recesses 102.

Figure 12:
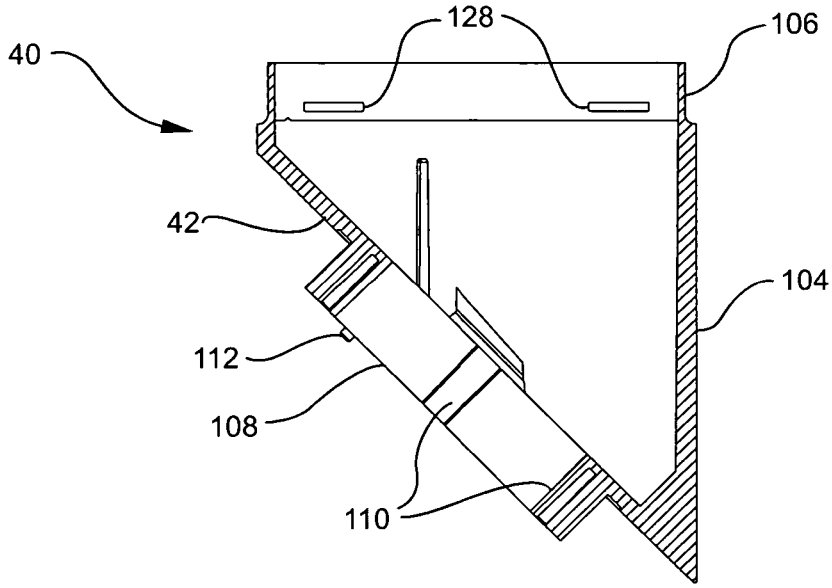
FIG. 12 is a sectional view of a base portion of the heater.
Figure 13:
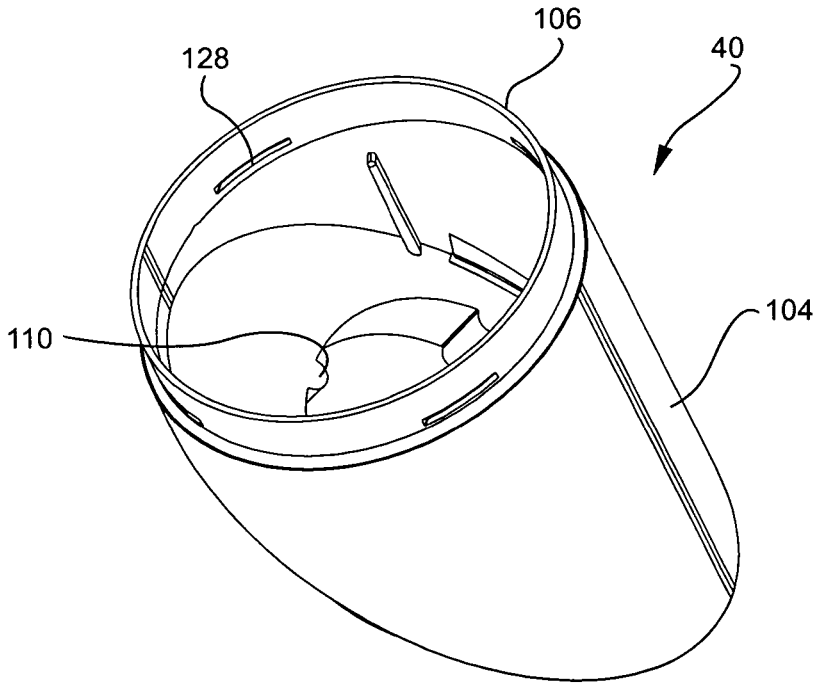
FIG. 13 is a top perspective view thereof.

Referring now to FIGS. 5, 12 and/or 13, the base portion 40 of the housing 14 includes a substantially cylindrical body 104, the bottom end including the inclined surface 42. The outside diameter of the base portion is reduced at the top end 106 so that the rear and front tower halves 70, 72 can be mounted thereto. A cylindrical projection 108 or neck extends from the inclined surface 42. It includes four generally semicylindrical columns 110 extending radially inwardly from its inner surface. The columns are equally spaced. A tab 112 extends axially from the bottom surface of the cylindrical projection. Two columnar protrusions 114 having curved surfaces extend radially outwardly from the outer surface of the cylindrical projection 108, as shown in FIG. 5.

The interrelationships of the base portion 40, base 12, neck retainer 80, detent ring 82 and neck bearing 84 are best shown in FIGS. 3–5. Referring first to FIG. 3, the neck retainer 80 adjoins the heat shield and the upper portion of the heater housing 58. The cylindrical portion 86 thereof extends through the detent ring 82 and neck bearing 84 and into the cylindrical projection 108 of the base portion 40. The columns 110 on the inner surface of the cylindrical projection 108 of the base portion are positioned within the channels 90 within the cylindrical portion 86. The neck retainer is affixed to the base portion 40 of the housing. The projection 92 is engageable within the inner surfaces of the base 12. It accordingly functions as a stop that limits rotation of the associated housing 14 or 16 to one hundred eighty degrees.

As best shown in FIG. 5, the detent ring 82 is positioned such that the projections 96 both engage inner surfaces of the base 12. It accordingly does not rotate upon rotation of the housing 14 or 16 and associated neck retainer 80. The columnar protrusions 114 are positioned within the opposed channels 98 of the detent ring 82 when the housing 14 or 16 is either upright or horizontal. The user can tactilely sense when the housing has been effectively rotated to either of these positions as the protrusions 114 snap into the channels 98.

The neck bearing 84 includes an annular flange portion located between the bottom surface of the base portion 40 or 44 of the housing and the outer surface of the base 12. The recesses 102 in the annular body portion of the neck bearing receive the columns 114 on the outer surface of the neck 108 of the base portion 40 or 44. The neck bearing facilitates the ability of the housing to rotate with respect to the base 12.

Figure 14:
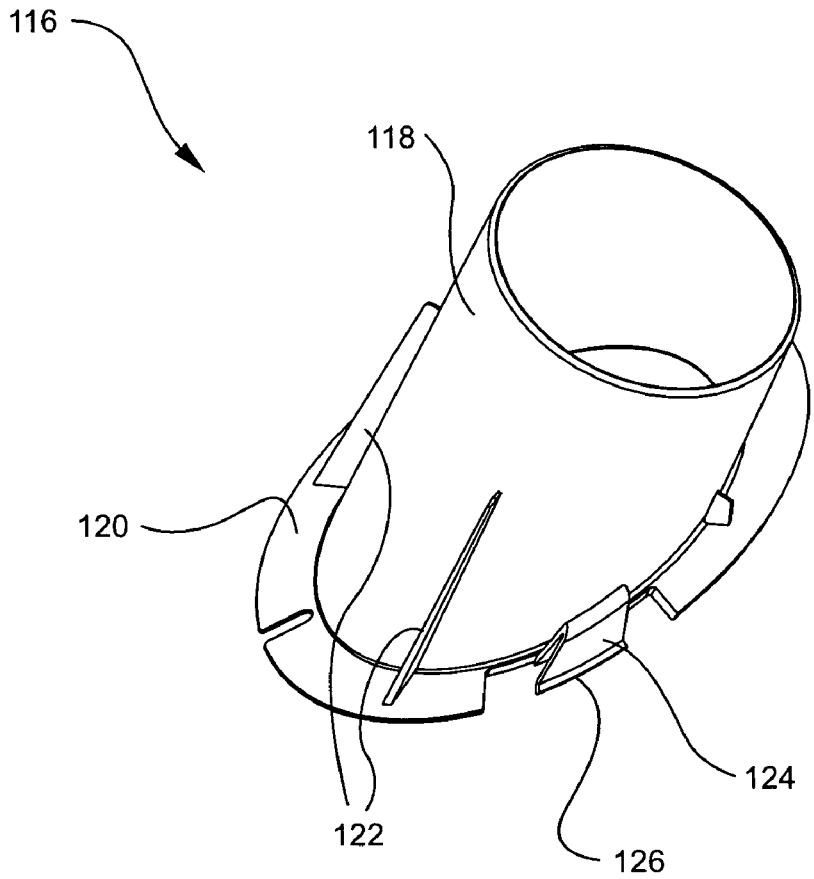
FIG. 14 is a top perspective view of a neck duct.
Figure 15:
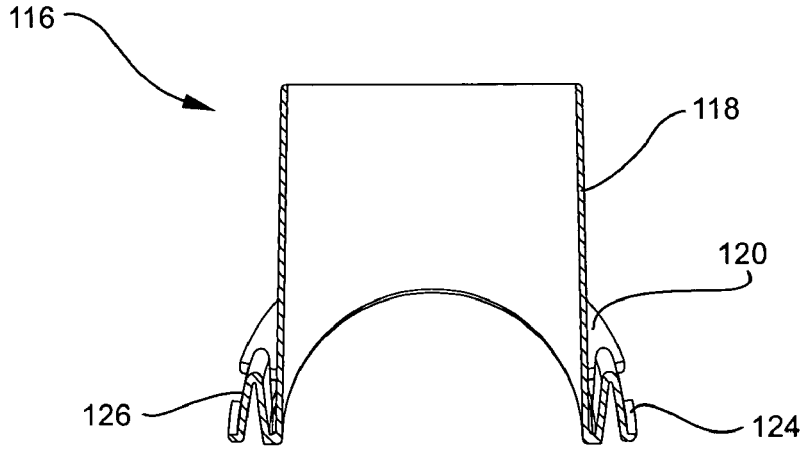
FIG. 15 is a sectional view thereof.
Figure 16:
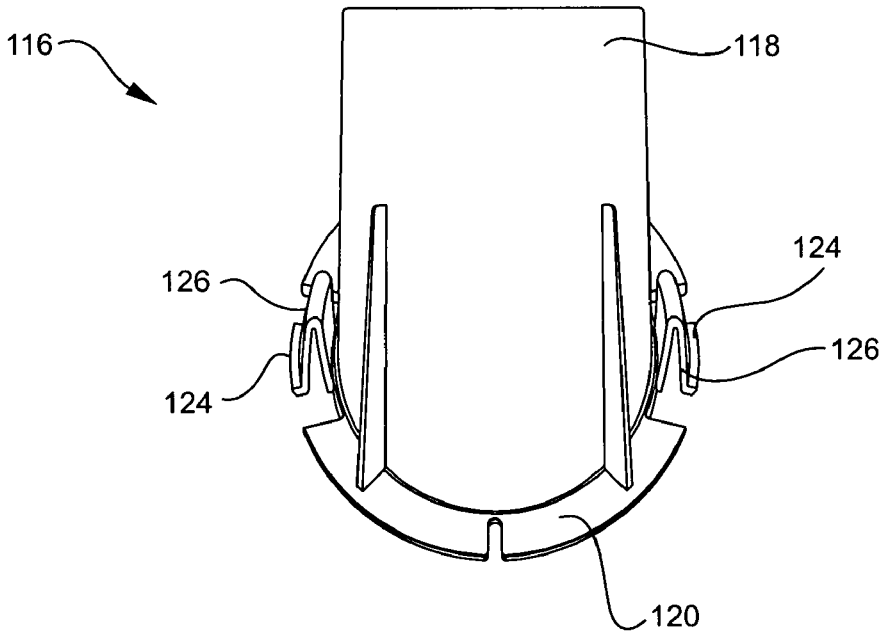
FIG. 16 is an elevational view thereof.

A neck duct 116 is coupled to the base portion 40 or 44 of each housing. This element is shown in detail in FIGS. 14–16. The neck duct includes a cylindrical body 118 and an annular flange 120 extending radially outwardly from the bottom end thereof. Four equally spaced fins 122 extend from the outer surface of the cylindrical body and adjoin the flange 120. The fins provide additional strength and rigidity to the cylindrical body. As the neck duct conveys heat from the heater housing 58 to the tower portions of the heater, it is preferably made from a material that is temperature rated to withstand such heat. Suitable plastic materials are known to the industry and commercially available.

A pair of spring clips 124 are integral with the cylindrical body 118 and positioned within gaps in the flange. The clips have protruding end portions 126 that are snapped into slots 128 in the upper end of the base portion 40 or 44 of one of the housings.

Figure 17:
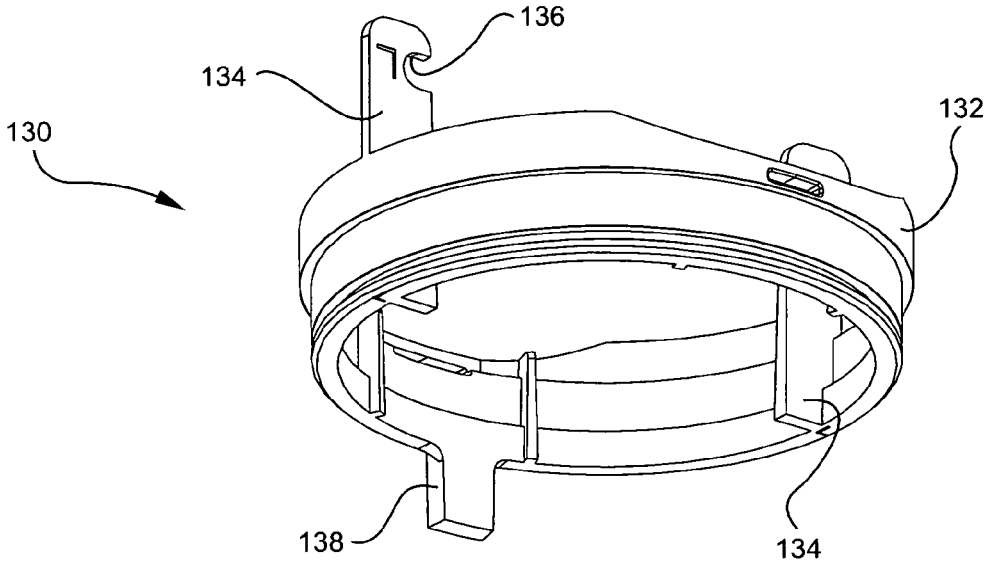
FIG. 17 is a bottom perspective view of a tower retainer.
Figure 18:
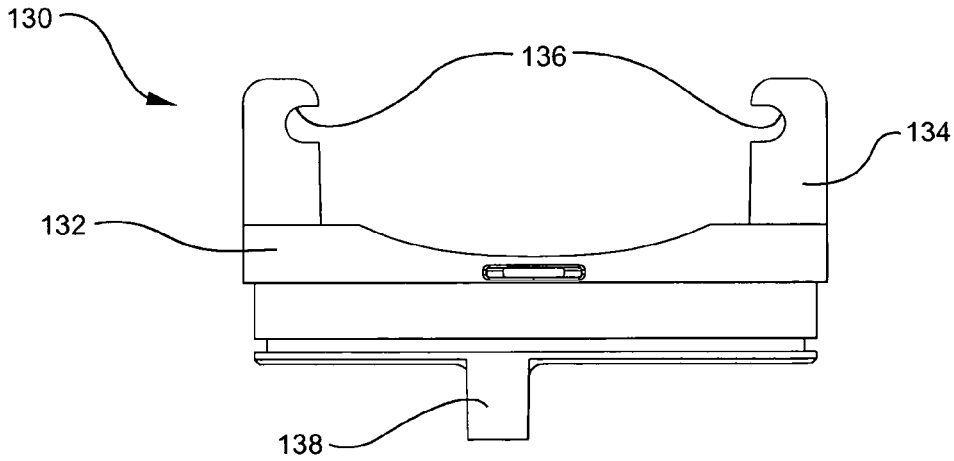
FIG. 18 is a side elevational view thereof.

A tower retainer 130 is mounted over the cylindrical body 118 of each neck duct 116. As shown in FIGS. 17 and 18, this element includes a generally annular body 132 including a stepped outer surface. A pair of columns 134 are integral with the inner surface of the annular body 132. An end portion of each column extends axially beyond the annular body and includes a notch 136. The notches are in diametrically opposing relation to each other and engageable with screw posts extending from the lower portion of the tower half 70. A single projection 138 extends axially from the bottom end of the retainer. This projection limits the angle of rotation of the tower portion 70, 72 of the housing 14 with respect to the base portion 40 of the housing 14 to one hundred eighty degrees.

A cap 140 is mounted to the top of each housing 14, 16. The upper end of each tower half 70, 72 is recessed to allow the cap to be mounted thereto.

The heater 10 provides considerable versatility for a user seeking to optimize heating comfort. Each housing 14, 16 is independently movable between vertical and horizontal positions. The tower portion of each housing is rotatable about its longitudinal axis to allow the user to direct heated air exiting the grills 18 in desired directions. The user can accordingly orient the housings as well as the grills to address a variety of heating needs. For example, it is sometimes desirable to direct heat from a baseboard heater upwardly as opposed to forwardly. The user is able to move the housings to the baseboard position of FIG. 2 from the upright position of FIG. 1, then turn each tower portion so that the grills face upwardly rather than forwardly as shown.

The preferred heater as disclosed herein includes one or more heating elements in the base as well as a fan in the base to move hot air into the housings and out through the grills 18. The principles of the invention are applicable to other types of heaters, including radiant heaters that may not have fans. The location of heating elements in the base is not considered essential to the practice of the invention. A heating element may instead be positioned within each housing.

The manner in which the housings are moved between vertical and horizontal positions can also be accomplished differently from that shown and described above. For example, a ball and socket connection could be provided between the housings and base with appropriate locking elements to retain the housings in selected positions.

It will be appreciated that other modifications can be made without departing from the spirit of the invention.

The invention claimed is:

1. A heater comprising:

a base;

a housing having a first end proximate to said base and a second end remote from said base, a heating element positioned within at least one of said base and housing, said housing including a portion allowing the release of heat generated by said heating element;

a coupling connecting said housing to said base such that said housing is rotatable about an axis extending between said first and second ends between a first, substantially horizontal position and a second, substantially upright position;

a second housing;

a second coupling connecting said second housing to said base such that said second housing is rotatable about an axis extending between a first end of said second housing proximate said base and a second end thereof remote from said base between a first, substantially horizontal position and a second, substantially upright position; and said second housing including a portion allowing the release of heat generated by said heating element.

2. A heater as described in claim 1 herein said housings are substantially coaxial when both are in first, substantially horizontal positions.

3. A heater as described in claim 2 wherein said heating element is positioned in said base, each housing including an interior space in fluid communication with an interior space in said base.

4. A heater as described in claim 3 including a fan in said base, said base including an inflow vent and each of said housings including an outflow vent for allowing the release of heat generated by said heating element.

5. A heater as described in claim 4 wherein each housing is elongate and comprised of a base portion coupled to said base and a tower portion rotatably mounted to said base portion.

6. A heater as described in claim 1 wherein said base includes first and second inclined upper surfaces, said first ends of said housings include inclined end surfaces, said inclined end surfaces of said housings adjoining, respectively, said first and second inclined upper surfaces of said base.

7. A heater as described in claim 6 wherein said base and said housings each includes an interior space, the interior spaces of said housings communicating with the interior space of said base, and a fan within said base.

8. A heater as described in claim 7 wherein said heating element is positioned within said base.

9. A heater as described in claim 1 wherein each housing is comprised of a base portion coupled to said base and a tower portion rotatably mounted to said base portion.

10. A combination baseboard and upright heater, comprising:

a base;

a first housing having a first end proximate to said base and a second end remote from said base;

a second housing having a first end proximate to said base and a second end remote from said base;

a first coupling pivotably connecting said base and said first housing such that said first housing can be moved to a substantially horizontal position and a substantially upright position;

a second coupling pivotably connecting said base and said second housing such that said second housing can be moved to a substantially horizontal position and a substantially upright position; and a heating element positioned within at least one of said base and said first and second housings.

11. A heater as described in claim 10 wherein said heating element is within said base.

12. A heater as described in claim 11 including a fan in said base.

13. A heater as described in claim 10 wherein each housing includes a grill.

14. A heater as described in claim 13 wherein each housing is elongate and includes a longitudinal axis, said longitudinal axes being substantially collinear when said first and second housing are in said horizontal positions.

15. A heater as described in claim 10 wherein each of said first and second housings is comprised of a base portion and a tower portion rotatably coupled to said base portion.

16. A heater as described in claim 15 wherein said base includes first and second inclined surfaces, said base portions of said first and second housings including inclined surfaces respectively adjoining said first and second inclined surfaces of said base.

17. A heater as described in claim 15 wherein said heating element is within said base.

18. A heater as described in claim 17 including a neck duct extending through each base portion and positioned to convey heated air from said heating element to said tower portions.

* * * * *